US007372972B2

(12) United States Patent
Ach-Kowalewski et al.

(10) Patent No.: US 7,372,972 B2
(45) Date of Patent: May 13, 2008

(54) EAR INSERT FOR HEARING AIDS

(75) Inventors: Gerhard Ach-Kowalewski, Effeltrich (DE); Harald Klemenz, Fürth (DE); Torsten Niederdränk, Erlangen (DE)

(73) Assignee: Siemens Audiologische Technik GmbH, Erlangen (DE)

( * ) Notice: Subject to any disclaimer, the term of this patent is extended or adjusted under 35 U.S.C. 154(b) by 505 days.

(21) Appl. No.: 11/064,726

(22) Filed: Feb. 24, 2005

(65) Prior Publication Data

US 2005/0190940 A1 Sep. 1, 2005

(30) Foreign Application Priority Data

Feb. 26, 2004 (DE) ..... 10 2004 009 268

(51) Int. Cl.
*H04R 25/00* (2006.01)

(52) U.S. Cl. ..... 381/328; 381/322; 381/324

(58) Field of Classification Search ..... 381/322–325, 381/328, 330, 380, 381, 314, 382, 338; 181/128, 181/129, 130, 135
See application file for complete search history.

(56) References Cited

U.S. PATENT DOCUMENTS 4,532,649 A 7/1985 Bellafiore
4,870,688 A 9/1989 Voroba et al.
5,002,151 A * 3/1991 Oliveira et al. ..... 181/130
2003/0198361 A1 10/2003 Heerlein et al.
2006/0115105 A1* 6/2006 Brumback et al. ..... 381/328

FOREIGN PATENT DOCUMENTS

| | | |
|---|---|---|
| DE | 35 05 099 A1 | 9/1985 |
| EP | 0 271 539 B1 | 6/1988 |
| EP | 0 354 698 B1 | 2/1990 |
| EP | 1 317 163 A2 | 6/2003 |
| GB | 2 155 276 A | 9/1985 |
| WO | WO 99/07182 | 2/1999 |

OTHER PUBLICATIONS

Michael Valente, Holly Hosford-Dunn, Ross J. Roeser; "Audiology Treatment"; 2000, pp. 71-73; XP 002328493; Thieme Medical Publishers, Inc.; New York, Stuttgart.

* cited by examiner

*Primary Examiner*—Huyen Le

(57) ABSTRACT

Active otoplastics (3) with integrated earpieces (4) are to be acoustically optimized. There is provision here for forming a sound outlet (8) into the otoplastic in accordance with acoustic conditions. If the sound outlet (8) has the form of an exponential horn, this results in advantages for supply of high tones. The earpiece (4) can be secured with the aid of an adapter (5) into the otoplastic (3) so that it can be exchanged.

8 Claims, 2 Drawing Sheets

EAR INSERT FOR HEARING AIDS

CROSS REFERENCE TO RELATED APPLICATIONS

This application claims priority to the German application No. 10 2004 009 268.0, filed Feb. 26, 2004 which is incorporated by reference herein in its entirety.

FIELD OF INVENTION

The present invention relates to an ear insert for a hearing system, especially a hearing aid, with a shaped part which can be pressed into the auditory canal of the ear, a capsule which is arranged so that it can be removed from the shaped part and an ear piece to supply sound to the ear which is arranged in the capsule.

BACKGROUND OF INVENTION

High-tone hearing aids with a largely open supply are very adversely affected both by sound radiation from the vent (the opening) and also by the attenuation properties of the sound tube for high frequencies. Therefore it is of great benefit to relocate the earpiece under such circumstances. In this case the earpiece is fixed or molded into an otoplastic or an earmold. The earpiece is connected via a cable connection to the hearing aid module which is accommodated behind the ear for example. The disadvantage of this layout however is that to service the device if the earpiece fails or becomes contaminated in the otoplastic, said otoplastic has to be replaced, which involves considerable effort and costs, since each otoplastic is formed individually.

In this context otoplastics are known to which an earpiece can be linked externally. Such an arrangement is used for pocket hearing aids. However this construction is too large in its design for normal use of BtEs.

Furthermore a behind-the-ear (BtE) device is known from EP 0 288 822 for which the ear insert comprises an earmold adapted to the contour of the auditory canal and a module shell which can be used inside it. The module shell is self-contained and contains any given electrical and/or electromechanical components, e.g. an earpiece and a microphone. After being placed in the ear, the insert largely disappears into the inner auditory canal and is thus practically invisible. The sound is directed from the earpiece over a small tubular channel to the eardrum.

Publication DE 35 04 891 A1 shows an ear insert for hearing aids with a shaped part which is arranged in a user's auditory channel and can be adapted to it. Within the shaped part there is filler material in which an earpiece is mounted on an oscillating support. A funnel-shaped hearing aid opening is attached to the output opening of the earpiece.

In addition Publication DE 102 14 189 A1 discloses a hearing aid with a housing and of a corresponding Cerumen protection system. An earpiece can be taken out of this housing.

Further, from EP 354 698 B1 a hearing aid is known featuring a shaped part which can be fitted into a user's auditory canal. This shaped part takes the form similar to a funnel at its ear drum-side end.

In addition U.S. Pat. No. 4,532,649 A discloses a hearing aid which features a contact in a cover. The contact is electrically connected to a battery when the cover is closed Finally from publication DE 37 88 566 T2 a hearing aid is known in which a an earpiece is arranged in a pillow in an auricle module If necessary the receiver or earpiece can be removed using an extraction strip.

SUMMARY OF INVENTION

An object of the present invention is to provide an ear insert which has the advantages of an exchangeable earpiece and features improved acoustic properties.

In accordance with the invention this object is achieved by an ear insert for a hearing system with a shaped part (also referred to as a molded padding) which can be fitted into the auditory canal of the ear and an earpiece which is arranged in the shaped part so that it can be removed, to conduct the sound to the ear, with a sound outlet formed in accordance with acoustic conditions being embodied between the earpiece and the side of the shaped part, which in the state in which the ear insert is placed in the auditory canal, is facing the eardrum The sound outlet is embodied in the capsule. This means that although the capsule for the earpiece is somewhat more expensive to manufacture, the shaped part by contrast is cheaper to manufacture. Preferably the sound outlet is embodied funnel-shaped. Ideally the sound outlet is in the form of an exponential horn which produces optimum impedance matching. On the side of the shaped part facing away from the eardrum a cover is fitted to which a cutout in the shaped part in which the capsule is placed can be closed off. This enables the capsule to be formed relatively simply without any fear of an unwanted shaking out of the earpiece from the ear insert. Optionally the cover can be designed to be removable from the shaped part, which makes the device easier to assemble in some cases.

An opening of the sound outlet facing the eardrum can in this case have a larger surface that an opening of the sound outlet facing the earpiece.

For high-tone hearing aids in particular this produces an improved acoustic impedance matching.

The sound outlet can be embodied in the shaped part. In this case a capsule or an adapter which allows the earpiece to be easily exchanged, can be produced at very low cost.

The capsule can be removable from the shaped part on the side facing the eardrum. The advantage of this is that—provided there is a corresponding stop—the capsule with the earpiece cannot shake free from the ear insert.

The shaped part can further be an earmold. This enables a precise individual adaptation to an auditory canal to be achieved.

The earpiece can be contacted via this cover. It this case it is useful for spring contacts to be used for making contact with the earpiece to be arranged on the capsule and/or the cover. This minimizes the installation effort involved in fitting or exchanging an earpiece in the ear insert.

The earpiece can also be embodied as one piece with the cover. I.e. the earpiece has a closure part so that the insertion of the earpiece and the closure of the cutout can be undertaken in one movement.

BRIEF DESCRIPTION OF THE DRAWINGS

The invention will now be explained in more detail on the basis of the enclosed drawings, which show.

the exemplary embodiments described in greater detail below represent preferred embodiments of the present invention.

DETAILED DESCRIPTION OF INVENTION

Figure 1:
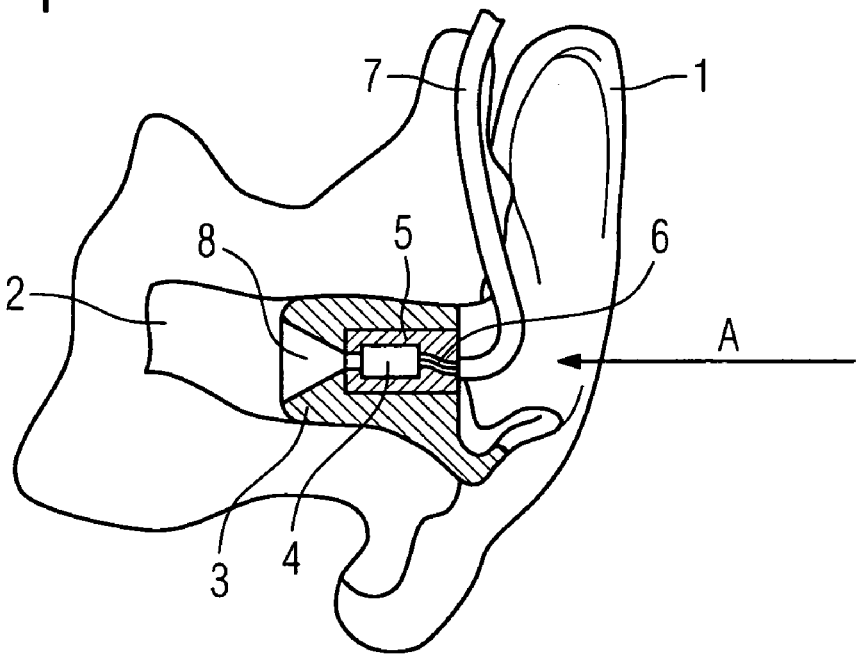
FIG. 1 a cross-section through an inventive ear insert corresponding to a first embodiment of the present invention.

FIG. 1 shows the ear of a hearing aid wearer including the auricle 1 and a cross-section through the auditory canal 2. An ItE shell or otoplastic 3 is fitted into the auditory canal 2 as a shaped part. An earpiece 4 including a corresponding capsule or a corresponding adapter 5 is inserted in a cutout of the otoplastic 3. The adapter 5 can be embodied as a component for a plug-in-, screw, bayonet or jack connection. The adapter 5 can however also be glued into the otoplastic for example with silicon or another commercially-available adhesive, but this loses the benefit of exchangeability.

Connections 6 for the earpiece 4 are routed out through the adapter 5. They are connected by a flexible lead 7 to the BtE device which is not shown.

The earpiece 4 in the otoplastic 3 is subjected to very extreme conditions with high temperatures (appr. 37° C.), high humidity (sweat) and earwax (Cerumen) which would lead to expectations of a short lifetime. In order not to have to manufacture a new, expensive otoplastic or ItE shell each time that the receiver is exchanged, the adapter 5 offers a significant advantage since it is very easy to exchange.

In this first embodiment of the capsule or the adapter 5 is inserted from outside in the direction of the arrow A into the otoplastic. This enables it to be taken out of the otoplastic 3 without the latter having to be removed from the auditory canal The adapter 5 is fixed in the otoplastic 3 with a corresponding opposing element of the plug-in, screw, bayonet or jack connector.

Figure 2:
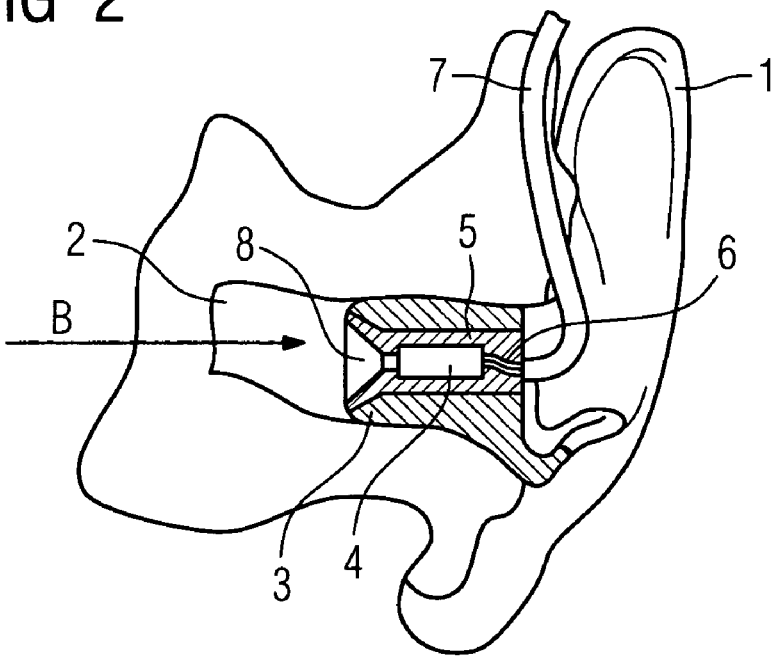
FIG. 2 a cross-section through an ear insert in accordance with a second embodiment.

On the side facing the ear drum the otoplastic 3 features a funnel-shaped sound outlet 8 indicated which can also be referred to as the sound channel. This sound outlet 8 can also be embodied so that it is similar to a horn and in particular has the form of an exponential horn. The acoustic engineer can adapt the form of the sound outlet to the acoustic circumstances, e.g. residual volume in the auditory canal, frequency spectrum of the earpiece supply, impedance matching etc, as required FIG. 2 shows the second embodiment of the inventive ear insert. With this embodiment only the adapter 5 is different in design to the first embodiment, so that, as regards the remaining elements, reference can be made to the description of FIG. 1.

With the second embodiment in accordance with FIG. 2 the adapter 5 is inserted or placed in the direction of the arrow B, i.e. from the side of the otoplastic 3 facing the ear drum. In this case the funnel-shaped sound outlet 8 is incorporated into the capsule or the adapter 5. In its external contours of the adapter 5 is slightly conical in shape so that it is prevented from shaking free outwards from the otoplastic 3 The adapter 5 can also be designed to have a strictly cylindrical outer contour as shown in FIG 1. In this case it is advisable to provide a corresponding stop so that the adapter 5 cannot unintentionally be shaken out. Alternatively the adapter 5 can also be spherical in design.

Figure 3:
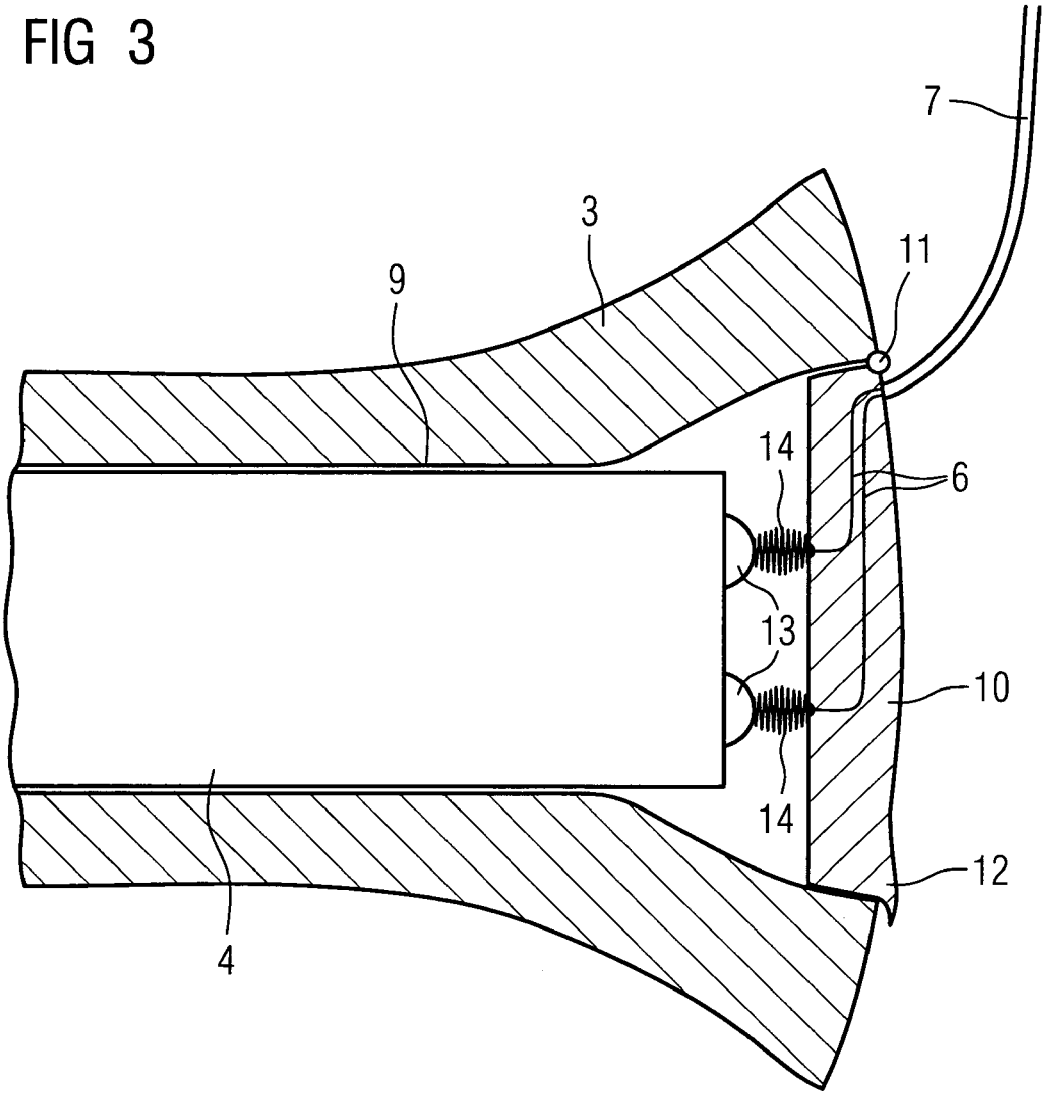
FIG. 3 a cross-section through of a part of an ear insert in accordance with a third embodiment of the present invention.

FIG. 3 shows a third embodiment of the present invention. This third embodiment can be combined with both the first and the second embodiment. A cutout 9 is embodied in the otoplastic 3 into which the earpiece 4 is inserted The cutout is closed off by a cover 10. The cover 10 for its part is attached by a hinge 11 to the otoplastic 3 and has a handle 12 for opening it. The connecting leads 6 are in this case routed through the cover 10. The flexible lead 7 is routed in its turn to the BtE. Like a battery, the earpiece 4 has two contacts 13. Spring contacts 14 which are attached to the cover 10 make the electrical contact between the contact points 13 and the leads 6 when at the cover 10 is in its closed state. This enables the earpiece 4 to be replaced with just a few operations.

Instead of the earpiece 4, an adapter or a capsule into which an earpiece is integrated could be inserted into the cutout 9 and contact established when the cover 10 is closed.

In accordance with the embodiment of the present invention described above an ear insert is thus produced with improved acoustic properties in which the earpiece is easy to exchange. This means that a new otoplastic does not have to be produced each time the earpiece is replaced, so that the use of active otoplastics in which the coupling tendencies are less because of the greater distance between earpiece and microphone becomes a more viable economic option.

The invention claimed is:

1. An ear insert for a hearing aid, comprising:

a molded padding sized and configured to fit into an auditory canal and having a cavity;

a cap for covering the cavity at a side of the cavity facing away from an eardrum of the auditory canal when the ear insert is fit into the auditory canal;

an acoustic earpiece arranged within the cavity, detachable from the molded padding and adapted to provide sound to the auditory canal; and a sound outlet operatively connected to the acoustic earpiece and configured to face the eardrum when the ear insert is fit into the auditory canal, wherein the sound outlet is at least partially included in a capsule accommodating the acoustic earpiece and shaped as an element chosen from the group consisting of a funnel and an exponential horn.

2. The ear insert according to claim 1, wherein the sound outlet comprises a first and a second opening, the first opening facing the eardrum, the second opening facing the acoustic earpiece and the first opening having a larger area than the second opening.

3. The ear insert according to claim 1, wherein the capsule is adapted to be inserted into and detached from the molded padding from a side of the molded padding facing the eardrum when the molded padding is inserted into the auditory canal.

4. The ear insert according to claim 1, wherein the molded padding is a fitting piece sized and configured to match the auditory canal.

5. The ear insert according to claim 1, wherein the acoustic earpiece is connected to an external sound processing device using the cap.

6. The ear insert according to claim 5, wherein an contact spring is attached to the acoustic earpiece and the capsule for connecting the acoustic earpiece to an external sound processing.

7. The ear insert according to claim 6, wherein the contact spring is also attached to the cap.

8. The ear insert according to claim 1, wherein the acoustic earpiece comprises the cap.

* * * * *